United States Patent [19]

Fischer

[11] 4,432,203

[45] Feb. 21, 1984

[54] ROTARY EXTERNAL COMBUSTION ENGINE

[75] Inventor: Victor H. Fischer, Artarmon, Australia

[73] Assignee: Thermal Systems Limited, Cayman Islands

[21] Appl. No.: 215,866

[22] Filed: Dec. 12, 1980

[30] Foreign Application Priority Data

Jul. 16, 1980 [AU] Australia ..... PE4553

[51] Int. Cl.[3] ..... F01K 21/04

[52] U.S. Cl. ..... 60/511; 60/514

[58] Field of Search ..... 60/508, 511, 512, 514, 60/650, 682, 674; 122/249

[56] References Cited

U.S. PATENT DOCUMENTS

| | | | |
|---|---|---|---|
| 8,380 | 9/1851 | Storm | 60/674 |
| 1,746,158 | 2/1930 | Loffler | 122/249 |
| 2,217,192 | 10/1940 | Wuehr | 60/514 |
| 3,192,705 | 7/1965 | Miller | 60/511 |
| 3,336,746 | 8/1967 | Southwick | 60/514 |
| 3,878,680 | 4/1975 | Dauvergne | 60/511 |
| 3,972,194 | 8/1976 | Eskeli | 60/650 |
| 4,016,724 | 4/1977 | Karlsson | 60/672 |
| 4,077,214 | 3/1978 | Burke | 60/512 |

FOREIGN PATENT DOCUMENTS

| | | |
|---|---|---|
| 2329020 | 1/1975 | Fed. Rep. of Germany . |
| 2325279 | 1/1975 | Fed. Rep. of Germany . |
| 2364930 | 7/1975 | Fed. Rep. of Germany . |
| 2416964 | 10/1975 | Fed. Rep. of Germany . |
| 2750925 | 5/1979 | Fed. Rep. of Germany . |
| 438551 | 11/1935 | United Kingdom . |
| 1081499 | 8/1967 | United Kingdom . |
| 1352510 | 5/1974 | United Kingdom . |
| 1531492 | 11/1978 | United Kingdom . |

*Primary Examiner*—Allen M. Ostrager
*Assistant Examiner*—Stephen F. Husar
*Attorney, Agent, or Firm*—Bernard, Rothwell & Brown

[57] ABSTRACT

A rotary external combustion engine wherein energy is transferred to air acting as a working gas by injection into the air of liquid water at a high temperature and pressure. The liquid water is injected either directly into the working space in the stator or into a preliminary mixing chamber. The water acts as a heat-transfer medium for heating the air. Spontaneous vaporization of the liquid water on injection increases the pressure of the air which drives the rotor before being exhausted. The exhaust water is recovered and recycled. The working space is scavenged and refilled with a fresh charge of air.

30 Claims, 6 Drawing Figures

ROTARY EXTERNAL COMBUSTION ENGINE

The present invention relates to a rotary external combustion engine i.e. an engine of the type having a stator and a rotor defining a working space of variable volume and wherein heat energy for powering the engine is supplied externally of the working space. In particular, the invention provides a novel operating cycle.

Many attempts have been made to produce an engine which combines high thermal efficiency in terms of converting applied heat energy into useful work, with acceptable power to weight and power to volume ratios for the engine. The internal combustion engine has a good power to weight ratio but a relatively low thermal efficiency. Of such internal combustion engines, the diesel engine is generally accepted to have one of the best thermal efficiencies (up to around 40 percent). Thermodynamically more efficient engines based on the Carnot, Stirling and Ericsson cycles have been built but these have not in general been commercial successes, largely on account of the problem of providing a small and efficient heat exchanger enabling the working gas to become quickly and efficiently heated by the external heat source.

The steam engine is a well known form of external combustion engine but its power to weight ratio is generally low, owing to its requiring a separate steam boiler and condenser. The steam engine generally uses dried steam or other dry vapor as the working fluid. However, the present invention is not concerned with such an engine but is concerned with an external combustion engine which uses a gas such as air as the working fluid.

The external combustion engine of this invention may comprise one or more stators and one or more rotors. Usually, the stator has a cylindrical bore in which the rotor is eccentrically mounted. The rotor may be provided with vanes so as to define between the stator and the rotor at least one working space of crescent-like shape. As the eccentric rotor rotates within the stator, the volume of each working space increases from a minimum to a maximum and then decreases to the minimum again every revolution. The construction of this embodiment is analogous to the construction of a vane-pump. However, other stator and rotor configurations are possible. In particular, the stator need not be cylindrical in cross-section but may be provided with two, three, four, five or more lobes. The rotor also need not be circular in cross section and may be provided with a plurality ridges which define with the stator the working spaces.

However, in a preferred embodiment, the rotor is of cylindrical cross-section and is provided with two or more vanes slidable in slots provided in the rotor so as to accommodate changes in the spacing between any given point on the rotor and the corresponding point on the stator, as the rotor rotates. Preferably, each vane is provided with biasing means to resiliently bias it against the bore of the stator, thereby sealing each working space. Such biasing means may be in the form of a spring, such as a coil or leaf spring, disposed in the bottom of each slot and operative between the bottom of the slot and the bottom of the respective vane to bias the vane outwardly.

Preferably, sealing means are provided between the axial ends of the rotor and stator to prevent leakage. Such sealing means are well known in the art and may include O-rings or labyrinth seals. The compression ratio employed may vary widely depending on the particular application of the engine. Thus in some applications a compression ratio as low as 1.5:1 perhaps lower may be employed. In other applications the compression ratio may be as high as 20:1.

Means are provided for inducting gas into each working space. In its simplest form a ram may be provided together with an inlet port to the working space for scavenging the exhaust gas and replacing it with a fresh charge. Alternatively, inducting means may be provided by providing the engine with appropriate valves and inlets such that an induction revolution wherein gas is inducted into each working space is provided between each working revolution wherein the gas is used to do work. However, it is preferred to provide a separate compressor to provide pressurised gas which is inducted into the cylinder every revolution at the appropriate time. Such compressor may be a rotary compressor, such as a vane or turbine compressor. Alternatively, the compressor may be a reciprocating compressor, preferably, the compressors are driven from the engine.

An injector is also provided for injecting pressurized preheated liquid heat-transfer medium into the gas. The purpose of the injected liquid medium is to enable heat transfer from the burner to the gas to be effected quickly and efficiently. Generally, the heated liquid medium is sprayed into the gas in the form of liquid droplets having a large surface area which enable rapid heat transfer to the gas to occur. The liquid medium may be injected into the gas before or after the gas in inducted into the working space. Although the liquid may be injected into unpressurised working gas, it is well known that greater thermal efficiency is achieved by injecting the liquid medium into the gas when in a compressed state.

Since the injected liquid medium allows heat transfer to the gas to be achieved more efficiently, smaller heat exchanger surfaces are required.

Consequently, the present invention envisages heating the liquid medium and allowing the gas to become heated by contact with the medium. The heat-transfer medium might be sprayed into the gas in the form of droplets. However, it is preferred that a vaporisable medium be used which flashes to a vapor on injection into the working gas.

To avoid confusion the following terms as used herein will be clarified. The gas into which heat-transfer medium has been injected will be referred to generally as wet gas. Gas into which heat-transfer medium has not been injected will be referred to as dry gas. The injected medium may be present in the gas in its liquid or vapor state.

The heating of the liquid medium and its injection into the gas may be achieved in a variety of different ways.

Firstly, the liquid medium may be heated in a compact heat exchanger, for example a coil of narrow bore tubing, to a high pressure and high temperature. Since such narrow bore tubing can withstand great pressures, it is possible to heat the medium up to its critical point. For special applications where the rate of heat transfer is to be high, it may be preferred to heat the medium to a temperature and pressure above its critical point. The hot pressurized liquid medium is then injected into the gas in a mixing chamber. A non-vaporising medium is preferably injected by means of an atomising injector.

Internal energy of the medium is rapidly transferred from the hot liquid droplets to the gas, thereby increasing its pressure very quickly. The heated and pressurized wet gas is then fed into the working space where it expands (usually polytropically i.e. non-adiabatically) to drive the rotor.

However, in a second most advantageous arrangement, the mixing chamber is dispensed with and the hot high pressure liquid medium which has been heated in the heat exchanger is injected directly into the working space. Thus, a charge of dry gas is generally inducted into the working space at its maximum volume and compressed adiabatically during the subsequent half revolution. When the working space has reached approximately its minimum volume, hot pressurized liquid medium is injected into the compressed and heated gas so as to raise the pressure of the gas still further. The hot pressurized gas expands and cools during the subsequent half revolution. When the working space has reached approximately its maximum volume the gas is exhausted from the working space.

Preferably, the heat-transfer medium is a vaporizable liquid, such as water, which at least partially flashes to vapor immediately it is injected into the working space. Thus, heat transfer between the hot water vapor and the gas is very rapid.

Therefore, it may be seen that in this second arrangement the injected liquid medium is merely acting as a heat transfer fluid which may enable the compressed gas to convert internal energy to mechanical work. If a vaporizable medium is employed, the heat transfer process is particularly effective provided that most of the heat-transfer medium leaves the working space in the liquid state, so that the latent heat of vaporization is not lost.

The present invention is to be distinguished from a steam engine in that the medium is maintained in its liquid form and not allowed to vaporize until it is introduced into the gas. This is in sharp contrast to a steam engine, wherein even if a flash boiler is used, the water is always introduced into the cylinder in the form of steam. In fact, since it is necessary to superheat the steam to remove water droplets in a conventional steam engine, it is not possible to directly flash liquid water into the cylinder of a steam engine since this would give rise to water droplets in the cylinder. However, in the engine according to the present invention, the presence of water droplets in the working space may be tolerated. Indeed in some cases it may be desirable to construct the stator and/or rotor so as to retain liquid medium in the working space after exhaust. Thus, the stator or rotor may be provided with suitable recesses.

It is necessary that the heated medium be maintained in the liquid state prior to injection. Although this may be achieved by using appropriate sensors to ensure that the temperature at a given pressure never exceeds the liquid boiling point, it has been found that if an orifice of suitable size is connected to the heat exchanger in which the liquid medium is heated and a flow of liquid medium is maintained through the heat exchanger, then the application of heat to the medium does not cause the liquid to boil. Thus, by correct choice of orifice size, complex temperature and pressure sensing devices may be avoided. So long as the orifice provides a pressure drop, the pressure in the heat exchanger will at all times be such that, as the temperature is increased, the pressure of the water in the heat exchanger will also increase and thereby be always below the boiling point. The orifice, of course, will form part of the injection means through which the liquid medium is injected into the gas.

The rate of working of the engine may be controlled by any of several means. It may be controlled by varying the amount of heat transfer medium injected into the stator; for example by using a variable displacement pump. The rate of working of the engine may be controlled by controlling the amount of heat supplied by the burner, for example by controlling the fuel supply to the burner (for a constant liquid volume injection rate).

Usually, the heat-transfer medium is recovered from the exhaust gas after the gas has been exhausted from the working space. The recovered medium, which will still be somewhat heated, may be recycled again to the heat exchanger so that its heat content is not lost. In this way, the medium acts merely as a heat transfer fluid and is not substantially used up.

Water is a preferred heat transfer fluid, not only because it is vaporizable, but also because it has a thermal conductivity which is high compared to the other liquids, for example heat transfer oils. Moreover, as will be explained later, means may be provided for recovering water produced by combustion in the burner. Thus, it may be possible to avoid any need for make-up water since this will be provided by water from combustion in the burner. Of course, it is possible to use other liquids, such as mercury, which has a thermal conductivity 10 times that of water, and sodium. However, mercury has other obvious disadvantages, such as cost and toxicity. When water is used an oil may be added to form a dispersion, emulsion or solution to assist lubrication of the engine.

In a particularly preferred embodiment of the present invention, the gas is a gas which is capable of taking part in the combustion process which occurs in the burner. In this way, the internal energy of the gas exhausted from the working space is able to be recovered. The gas may be a gas capable of supporting combustion, such as oxygen, air or other oxygen-containing gas, or nitrous oxide. Alternatively, the gas may itself be a combustible gas chosen from all known combustible gases, such as gaseous hydrocarbons, carbon monoxide or hydrogen. Thus, some or all of the exhaust gas may be fed to the burner.

The fuel burnt in the burner itself may be chosen from known combustible fuels such as gasolines, fuel oils, liquefied or gaseous hydrocarbons, alcohols, wood, coal or coke.

It is in general preferred to use various heat recovery means. Thus, the whole engine may be enclosed in a heat insulating enclosure and be provided with heat exchangers to pick up stray heat and transfer it to, for example the compressed gas or to preheat the fuel for the burner. It is also preferred to recover the heat remaining in the burner flue gases and this may be achieved by passing the flue gases through a spray chamber in which a stream of liquid (generally the same liquid as that injected into the engine) is sprayed through the flue gas. When injection of a vaporizable medium is employed, it is preferred that the vaporizable liquid medium be sprayed through the flue gases to heat the medium close to its boiling point prior to being passed to the heat exchanger. Moreover, when water is employed as the injected medium, the use of a water spray chamber or a condenser is advantageous in that water from the burner may be condensed out of the flue gases so that it is not necessary to provide make-up water to the engine.

The construction of an engine according to the present invention is considerably simplified in certain respects in comparison with known engines, such as internal combustion engines. Thus, the temperatures encountered in the working space are generally reduced, thereby simplifying sealing of the working spaces. It will be appreciated that power may be provided in the engine of the present invention at much lower temperatures than, for example an internal combustion engine. Moreover, the internal combustion engine is less thermally efficient in that means must be provided to cool the cylinders and prevent seizing up.

Moreover, since the temperatures encountered in the engine are relatively low, for example up to 350° C., it is not usually necessary to construct the cylinder of metal. Plastics such as polytetrafluorethylene (PTFE), fiber-reinforced resins, and other plastics used in engineering, are particularly advantageous due to their cheapness and ease of use. In some constructions the use of plastics materials having a low heat conductivity can be an advantage in ensuring that that portion of the stator at which heat is introduced into the working space is kept at a relatively high temperature, whereas the gas outlet is kept at a relatively low temperature. Other heat insulating materials such as wood, concrete, glass or ceramics may also be used.

Power is taken from the engine by means of a shaft attached to the rotor. It will be appreciated that the engine is susceptible of high speed operation and is thus ideal for providing a small power plant suitable for a mobile vehicle. The engine is also ideal for high speed applications such as generating electricity.

In comparison to a steam engine, the engine of the present invention is less bulky in that a large high pressure boiler is not required since the liquid is heated in its liquid state in a very much smaller heat exchanger. Also, there is no need for a condenser, although a trap or spray chamber to recycle water is desirable. In comparison to the internal combustion engine, the engine of the present invention is capable of greater themal efficiency, both in terms of the amount of heat converted to work in the stator and also in terms of the amount of heat obtained from the fuel burnt, since complete combustion is rarely obtainable in an internal combustion engine. The burner parameters of the engine of the present invention may be optimised so as to ensure substantially complete combustion of the fuel in the burner, thereby substantially eliminating pollution in the form of unburnt fuel or carbon monoxide.

In comparison to known gas engines, the present invention allows the bulky gas heat exchanger to be replaced by a compact liquid heater.

BRIEF DESCRIPTION OF THE DRAWINGS

Embodiments of the invention will now be described with reference to the accompanying drawings wherein.

DESCRIPTION OF THE PREFERRED EMBODIMENTS

Figure 1:
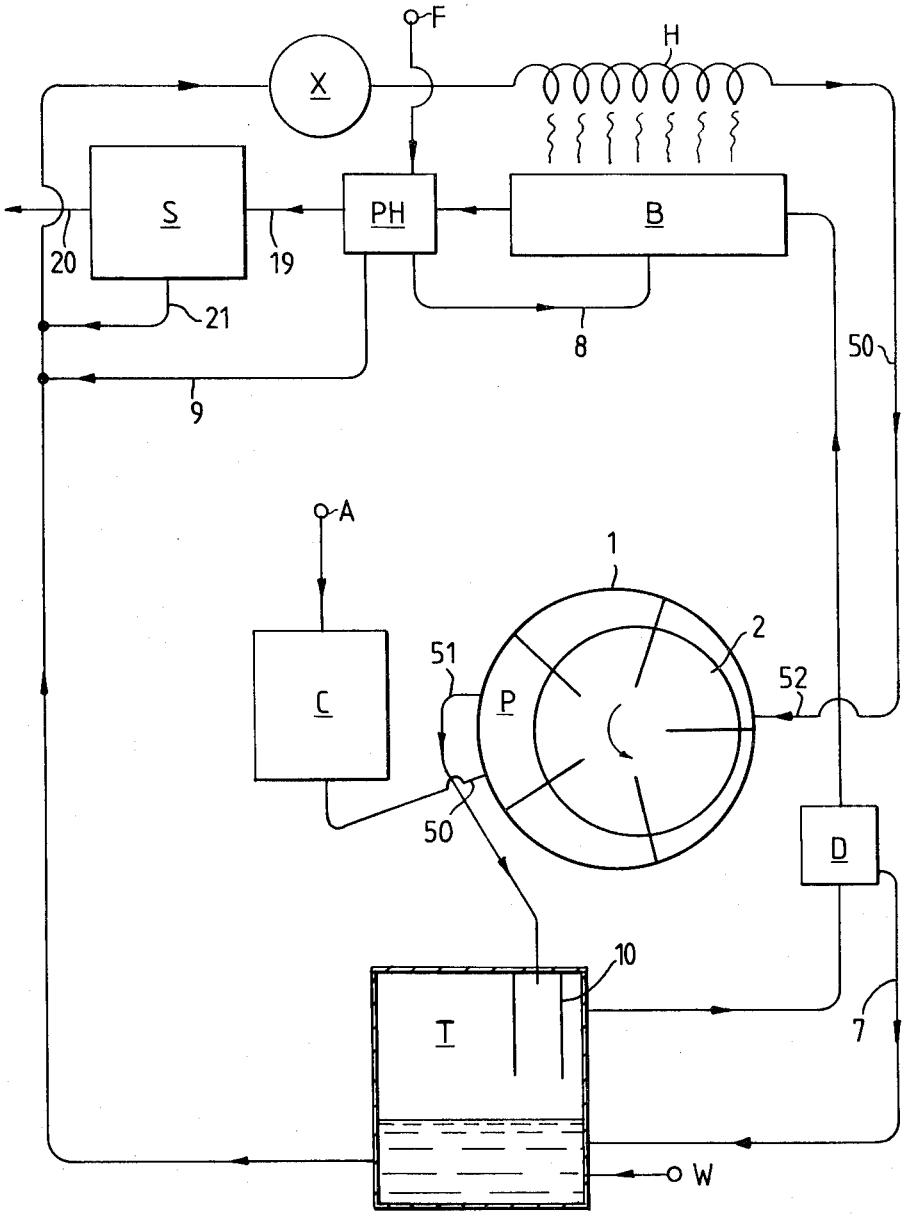
FIG. 1 is a schematic view of a rotary external combustion engine according to the present invention.

In carrying out the invention in one form thereof, the rotary external combustion engine, shown in FIG. 1, comprises a stator 1 having a cylindrical bore, an eccentrically mounted cylindrical rotor 2 rotatable within the stator, vanes 3 slidably mounted on the rotor and defining working spaces P, a compressor C for feeding compressed air to working space P. The compressor C may be a rotary compressor. The engine further comprises a pump X for feeding pressurized water to the heating coil H of a heat exchanger, and a spray chamber S for spraying water through flue gases from the burner B so as to cool and wash the flue gases and preheat the water. An optional preheater pH is provided for preheating fuel to the burner and is especially applicable for heavy fuel oils. There is a trap T for recovering liquid water from the wet exhaust gas from the working space.

Atmospheric air A is compressed by compressor C and inducted into a working space of the engine through inlet 50. The working space P has substantially its maximum volume. On rotation of the rotor 2 in the direction indicated in the arrow the air is compressed as the volume of the working space P decreases. When the working space volume is substantially at a minimum hot liquid medium injected from the heat exchanger through inlet 52 so as to heat the compressed gas in the working space. In lieu of injecting the heated liquid from the heat exchanger directly into the stator, it may be injected indirectly by first directing it to a mixing chamber where it is mixed with gas from the compressor C and then supplied to the stator.

The arrangement shown in FIG. 1 uses water, which is a vaporizable liquid, as the heat-transfer medium. However, other suitable vaporizing or non-vaporizing liquids might be used.

The injected water is at a high temperature and under a sufficient pressure to maintain it in its liquid state. As the water is injected into the working space P, a portion of the water immediately flashes to vapor which becomes mixed with the compressed air. Rapid heat transfer occurs and the temperature of the compressed air is increased. Further rotation of the rotor 2 allows expansion of the gas as it does work and leads to a reduction in its temperature and pressure.

The compression ratio employed may vary widely depending on the particular application of the engine. Thus in some application a compression ratio as low as 1.5:1 or perhaps lower may be employed. In other applications the compression ratio may be as high as 20:1.

On further rotation, the working space P reaches outlet 51 through which gas is exhausted. On further rotating of the rotor 2, the working space encounters the inlet 50 once again and the cycle recommences.

Exhaust gas from outlet 51 contains liquid droplets and vapor. A trap T is provided in order to recover the liquid water droplets from the exhaust gas from the working space P. Exhaust air and water vapor is then fed to burner B via a dryer D. Any condensate from the dryer is returned to the trap along line 7. Water from the trap is returned to the heating coil H.

Thus, the operation of the engine is as follows. Preheated water from the trap T is fed by means of a high pressure pump X (for example a positive displacement piston pump) to a heating coil H formed of narrow bore tubing. The water is then heated by means of the burner B to a high temperature and pressure, for example 300° C. and 86 bar. The water will generally be heated to temperature below its critical temperature and pressure (220.9 bar and 374° C.), however the pressure will always be such that at any temperature it will maintain the water in its liquid state. The hot pressurized water then passes through a pipe 50a to an inlet 52 to the interior of the stator 1. The inlet 52 communicates with a pair of closely spaced ports 53 which are arranged side by side such that at any given time only one of them is obstructed by a vane 3, thereby ensuring continuity of flow into the working spaces of the rotor/stator assembly (see FIG. 4). The working space P in communication with a port 53 contains compressed and somewhat heated air which has been delivered from the compressor C through inlet 50. On entering the working space P a proportion of the hot pressurized liquid water instantaneously flashes to vapor, thereby increasing the pressure in the working space at substantially constant volume (i.e. along line bc in FIG. 5). The hot pressurized air expands, rotating the rotor 2 in the direction indicated by the arrow until the working space P encounters the outlet 51. This corresponds to the line cd in FIG. 5 and results in increase in volume with decrease in pressure and temperature, such that some of the water vapor recondenses giving up its latent heat of vaporization. The exhaust gas is then fed through the trap T to the burner.

Figure 2:
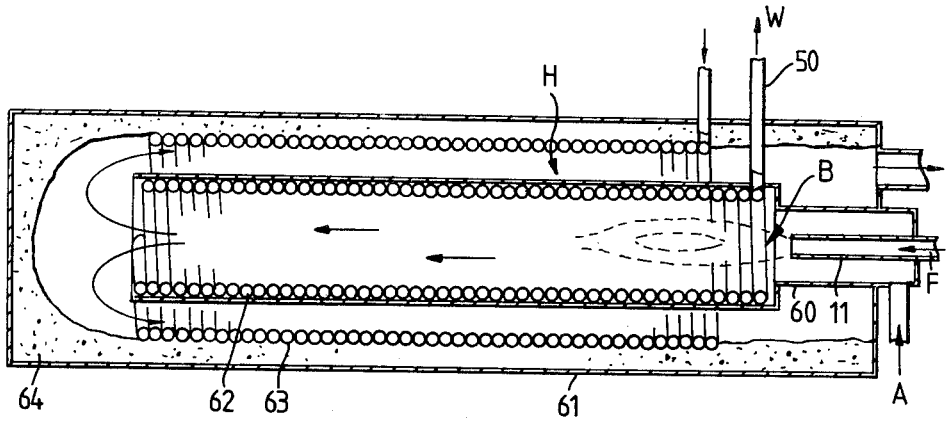
FIG. 2 is a schematic cross-sectional view of a heat exchanger of the engine.

FIG. 2 shows the construction of the heat exchanger, which combines the heating coil H and the burner B. The heat exchanger comprises inner and outer coaxial sleeves 60 and 61, respectively, defining a double path for flue gas from the burner. Insulation 64 is provided around the outside of the heat exchanger. A fuel inlet jet is provided for burning fuel F in air A admitted via an air inlet. Water W passes through a heating coil H which comprises an inner coil 62 and outer coil 63 in the direction indicated by the arrows such that water exits from inner coil 62 at a position close to the highest temperature of the burner. The hot pressurized water is then fed along pipe 50a prior to injection into the working space P.

The heat exchanger may be provided with suitable temperature and pressure sensing devices to ensure that the liquid in the heating coil H is always maintained in its liquid state and not allowed to vaporize. However, it has been found in practice that it is not necessary to carefully monitor the temperature and pressure to avoid vaporization. Thus, it has been discovered that, provided the heating coil H is always in communication with an aperture through which the liquid is continually passed (i.e. one or other of the inlet ports 53) the application of further heat in the heating coil H causes an increase in temperature and pressure but does not, at least in the case of water, cause the liquid to boil. It is, of course, necessary that the aperture (or ports 53) be suitably sized to maintain the necessary pressure differential across it. However, this may be established by the skilled man by suitable experimentation.

Figure 3:
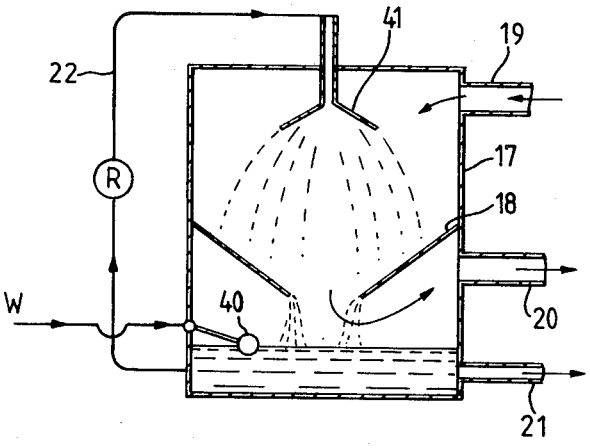
FIG. 3 shows a spray device for cooling flue gas from the burner.

FIG. 3 shows a spray device for cooling and washing the flue gases from the burner B and thus recovering some of the heat and some water produced by combustion. It comprises a spray chamber 17 having therein a funnel 18 onto which water is sprayed by spray 41 through the stream of hot flue gases. The flue gases are inducted via inlet 19 and arranged to flow tangentially round the chamber before exiting through the exit 20 as cooled flue gas. The flue gases thus pass through the spray and then through a curtain of water falling from the inside aperture of the funnel 18. Preferably, the flue gases are cooled to below 100° C. so as to recover the latent heat of vaporization of water in the wet exhaust air and also to recover water produced by combustion in the burner. Water at substantially 100° C. exits through the outlet 21 before being fed by metering pump X into the heat exchanger. If necessary, cold feed water W may be introduced into the chamber via a ballcock 40 for maintaining a constant level of water in the bottom of the spray chamber. A recycle pump R and associated ducting 22 is provided for recycling the water through the spray to bring it up to its boiling point. However, in practice if it is desired to cool the flue gases below 100° C., it may be necessary to withdraw water through the outlet 21 at a substantially lower temperature e.g. 50° C. Water condensed out of the burner flue gases in the optional preheater PH may also be recycled via line 9 to the pump X. The preheater PH is adapted to preheat the fuel fed to burner B along line 8, and may simply comprise a coil of fuel piping arranged in the flow of fuel gas from the burner or any analogous device known to the skilled man.

Figure 4:
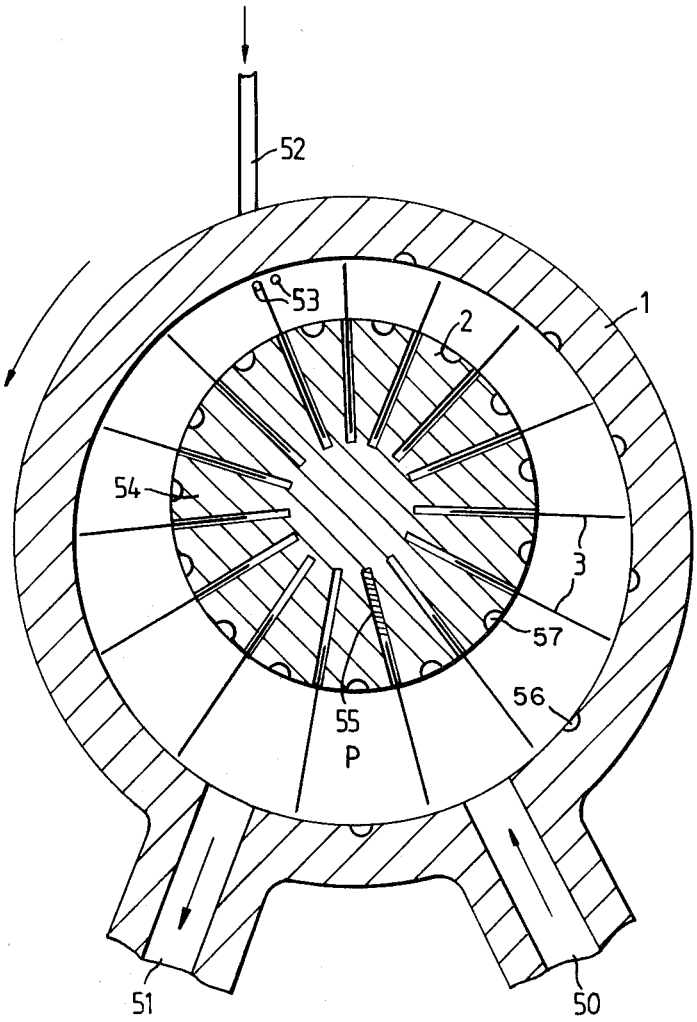
FIG. 4 shows in partial cross section a stator and rotor assembly of the engine.

FIG. 4 shows in detail the construction of the rotor/stator assembly. For temperatures up to several hundred degrees centigrade, the assembly may be formed of suitable plastics material, which enables the assembly to be lightweight and to be produced relatively cheaply. However, if higher thermal efficiencies and thus higher temperatures are required, other appropriate materials such as metals may be used. The rotor 2 is eccentrically mounted within the cylindrical bore of the stator 1 and conventional sealing means are provided at the ends of the bore so as to seal the rotor to the stator. Each vane 3 provided on the rotor 2 is slidably disposed in a respective slot 54 and outwardly biased by means of a coil spring or leaf spring 55 (only one shown) disposed in the bottom of the slot. The rotor is mounted on a rotatable shaft (not shown) which extends out of the stator 4 supplying power.

The inlet 52 for injecting the heated pressurized liquid into the working spaces, communicates with a pair of adjacent ports 53 in the end surface of the cylindrical bore of the stator. The use of a pair of ports 53 ensures that while one of the ports is obstructed by the edge of a vane 3, liquid continues to be injected through the other port 53 thereby ensuring continuity of liquid flow from the heating coil H. Thus, abrupt shocks to the high pressure liquid are avoided. Liquid flows continuously through the inlet 52 into whichever of the working spaces is in front of an inlet port 53. Therefore, no complicated valving is required. In lieu of injecting liquid from the heat exchanger directly into the stator, through liquid inlet 52 the liquid may be introduced into a mixing chamber where it is mixed with compressed gas before being injected into the stator through inlet 50. In that case liquid inlet 52 would be eliminated and inlet 50 would be relocated to a position approximately 180° C. from outlet 51, that is to a position essentially the same as that of the inlet 52 shown in FIG. 4.

Compressed air is introduced into a working space through inlet 50 which opens directly into the bore of the stator 1. As each working space P comes into communication with inlet 50 it is filled with pressurized air from the compressor C.

The construction of outlet 51 is similar to the construction of the inlet 50. Thus, the outlet 51 opens into the interior bore of the stator and exhausts gas from each working space P in turn during rotation of the rotor. The outlet 51 is disposed approximately 180° C. of rotation away from the injector.

The construction shown in FIG. 4 is also advantageous in that it is desirable to maintain the inlet 50 and outlet 51 as cool as possible to reduce the temperature at which gas is exhausted, while maintaining the temperature of the stator in the region of the hot pressurized liquid inlet 52 as high as possible so as to maintain a high temperature at which heat is introduced to the working space. This improves the thermal efficiency with which work is derived from the heat supplied to the working spaces. The use of a material, such as a plastics material of low thermal conductivity for the stator 1 enables a higher temperature differential to be maintained between the inlet and outlet 50, 51 on the one hand and the hot liquid inlet 52 on the other hand. The disposition of the inlet and the outlet approximately 180° C. of rotation from the injection also assist in maintaining this desirable temperature differential.

For improved scavenging inlet 50 and outlet 51 may be more closely spaced, so that for a time each working space communicated with both simultaneously.

To retain a small amount of residual water in the stator, recesses 56 may be provided. Alternatively, the outlet 51 could be formed to include a plurality of ports arranged along a plane so that the lands between the ports would serve to retain a small amount of residual water. If desired, the rotor, or the vanes thereof, could be formed to include recesses 57 or flanges for retaining a small amount of residual water.

Figure 5:
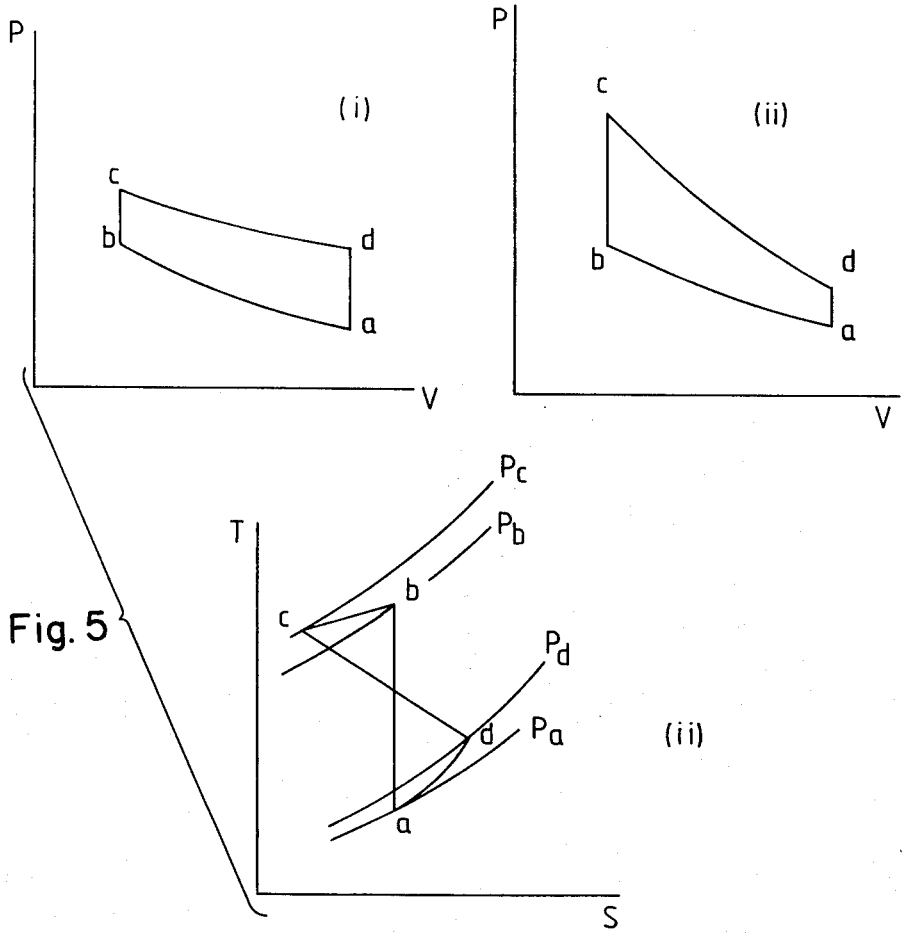
FIG. 5 shows pressure (P) versus volume (V) and temperature (T) versus entropy (S) relationships for the rotary external combustion engine of the present engine.
Figure 6:
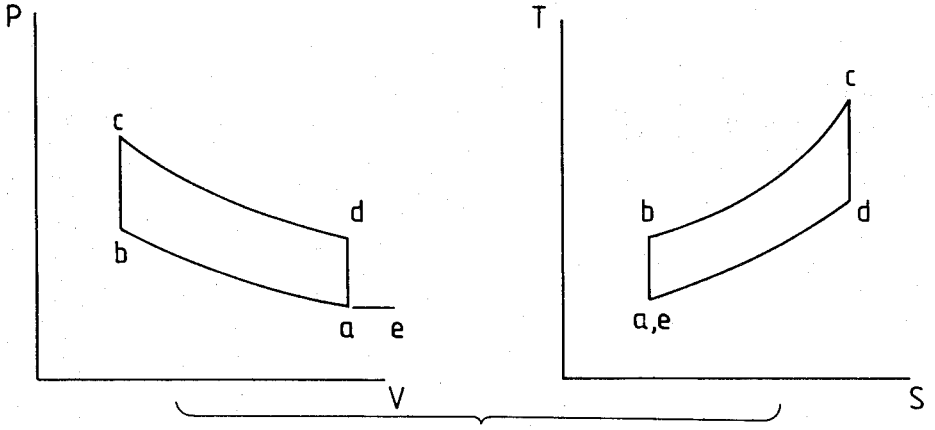
FIG. 6 shows the PV and TS diagrams for the known two-stroke internal combustion engine.

Without wishing to be limited by a theoretical discussion, FIGS. 5 shows the idealized thermodynamic operation of the engine of FIG. 1. FIG. 6 shows for comparison the operation of a two-stroke internal combustion engine.

FIG. 5 (i) is the PV diagram for the case when hardly any of the injected water flashes to vapor, the majority remaining in the liquid phase as droplets. This will occur when the rate of vaporization is slow compared to the rate of rotation of the rotor.

FIG. 5 (ii) is the theoretical PV and TS diagrams for the case when all the injected water vaporizes to the gaseous state. This might occur in a slow working engine.

In FIG. 5 (i) air in the working space P is compressed adiabatically (i.e. the gas constant is approximately 1.39) along line ab. The compression is also isentropic and heats the air. At constant volume liquid water is injected and a small amount of water vapor produced at the same temperature as the compressed air so that the pressure increases along bc. Considering only the air in the working space, there is no change in T provided the injected water is at the same temperature. As the rotor rotates the wet air expands among cd; however, due to the presence of hot liquid water droplets the expansion is not adiabatic but polytropic (typically the gas constant is between 1.33 and 1.35) so that the curve cd on the PV diagram is flattened. The expansion also produces a fall in T and increase in S. The gas is then exhausted from the working space so that the pressure of gas in the working space falls along da.

This replacement of hot pressurized exhaust air by cooler charge air constitutes a fall in both T and S.

FIG. 5 (ii) shows the situation wherein all the water flashes to the vapor state. In this case, the rise in pressure along bc is much greater, but the rate of pressure drop along cd is also quicker since the absence of liquid water droplets ensures that the air expands almost adiabatically. Thus the work done (i.e. the area of the figure abcd) in both cases (i) and (ii) is the same.

The PV and TS diagrams show the theoretical equilibrium situation when all the injected water is vaporized i.e. in a slow working engine when less than the amount of water required to saturate the air is injected. For the sake of illustration the injected water is at a slightly lower temperature than the compressed air in the cylinder.

As before, air is compressed adiabatically (gas constant is about 1.39) along ab at constant entropy. Typically, the pressure $P_a$ at a is 1 bar and the temperature $T_a$ is 300K (27° C.). At a compression ratio of 6:1 the air pressure $P_b$ and temperature $T_b$ at b rise to around 12 bar and 603K (330° C.).

Liquid water at 573K (300° C.) and 86 bar is then injected into the compressed air and all becomes vapor. Typically in order to produce a 10 horsepower output about 5 ml of water is injected at b. This causes an increase in pressure along bc (typically $P_c$=25 bar) and a decrease in temperature due to injection of the slightly cooler water $T_c$=586K (313° C.)). If the water is at the same temperature as the compressed air the line bc on the TS diagram is horizontal. The reduction in entropy along bc of the air in the cylinder arises from the added partial pressure of the water vapor.

As the working space expands, the wet gas expands (gas constant is about 1.34) along cd to a pressure $P_d$ of about 2 bar and a theoretical temperature $T_d$ of about 319K (46° C.). In practice due to non-theoretical behavior the temperature will be higher e.g. 80°-90° C.

The gas is then scavenged from the working space along da as before causing a decrease in temperature, pressure, and entropy of gas in the working space.

In the TS diagram $P_a$ to $P_d$ indicate the constant pressure curves. The net area of the two closed figures in the TS diagram represents the heat added to the air. In the case shown this is negative since injection of the water cools the air. When the water is at the same temperature as the compressed air at b the areas of the two closed figures on the TS diagram cancel out i.e. no heat is added.

FIG. 6 shows PV and TS diagrams for the known two-stroke cycle internal combustion engine for comparison. It is analogous to the cycle of case (ii) above. The line ae represents the opening of the exhaust valve before the end of the stroke in a conventional two-stroke engine.

The external combustion engines shown are capable of high efficiency. Theoretically, cold air A, cold fuel, and cold water W (if necessary) are inducted into the engine, and cold flue gases are vented. Therefore, almost all the heat given out by the burner may become converted into work.

It will be appreciated that the engine of the present invention may be simply constructed since it requires no valves and does not require high strength materials. The high rotational speeds obtainable make the rotary external combustion engine ideally suited for application to vehicles, where a high power to weight ratio is needed. Thus, the rotary external combustion engine according to the present invention features power to weight and power to volume ratios comparable to internal combustion engines but having a superior thermal efficiency. Moreover, since it is possible to arrange the combustion conditions in the burner to an optimum, it is possible to achieve almost complete combustion of the fuel to carbon dioxide and water and thus avoid carbon monoxide or unburnt fuel impurities in the exhausted flue gases. In particular, since the combustion occurs substantially at atmospheric pressure, there is almost no generation of nitrogen oxides during the combustion process. Therefore, this engine represents an improvement over internal combustion engines not only in terms of thermal efficiency but also as regards pollutant emissions.

Moreover, the engine is capable of utilizing a wide variety of fuels, for example gasoline, fuel oil, gaseous or liquefied hydrocarbons (including methane, butane and propane), alcohols and even solid fuels such as wood coal or coke. The burner parameters may be adjusted to ensure substantially complete and pollution-free combustion. Furthermore, such an engine could be made to run more quietly than conventional internal combustion engines.

While it is contemplated that this invention will be carried out by manufacturing new engines incorporating the features disclosed in this invention, it may also be carried out by converting some existing rotary motive devices to operate in accordance with the principles of this invention. For this purpose a kit may be supplied incorporating the necessary components for making such a conversion. Such a kit would include a heat exchanger, including a fuel-air burner, for heating water to the necessary temperature and pressure; a heat insulated stator and rotor, the stator having an inlet for gas and an outlet for wet exhaust gas; a compressor for inducting gas into the stator; a pump for transmitting water from the stator to the heat exchanger, an injector for injecting liquid water under pressure from the heat exchanger into the stator, a metering device for controlling the amount of water injected into the cylinder, and a separating chamber for separating condensed water from dry saturated vapor. The kit could also include, optionally, a mixing chamber for mixing compressed gas and liquid heat transfer medium.

It is claimed:

1. A method of operating a rotary external combustion engine having a stator and a rotor therein defining a working space, wherein energy is transferred to a working gas from a heated vaporizable liquid heat-transfer medium, which comprises (1) inducting working gas into the working space;

(2) generating externally of the working space heated heat-transfer medium under a pressure such as to maintain the medium in the liquid state;

(3) after induction, injecting heated liquid medium into the working gas and allowing at least part of the liquid medium to vaporize, so as to raise the internal energy of the gas;

(4) in an expansion cycle wherein the volume of the working space increases, allowing the wet gas containing the heat-transfer medium to expand thereby driving the rotor;

(5) exhausting wet gas from the working space near the end of the expansion cycle;

(6) separating liquid heat-transfer medium from wet exhaust gas containing heat-transfer medium vapor; and (7) recycling the separated liquid medium to stage (2) above.

2. A method according to claim 1 wherein the heat transfer medium is selected from, the group consisting of water, oil, and mixtures thereof.

3. A method according to claim 1, wherein the working gas is compressed before the heated liquid medium is injected into the gas.

4. A method according to claim 1 wherein the liquid medium is injected continuously.

5. A method according to claim 1, wherein the temperature and pressure of the wet exhaust gas are such that substantially all of the heat transfer medium is exhausted in the liquid phase.

6. A method according to claim 1 wherein the working gas is a gas capable of supporting combustion.

7. A method according to claim 6, wherein the heat exchanger comprises a burner and the exhaust gas is fed to the burner for combustion therein.

8. A method according to claim 1, wherein the heated liquid medium has a temperature and pressure below its critical point but greater than its boiling point at atmospheric pressure.

9. A method according to claim 1, wherein the heat transfer medium is water, the recovered exhaust water is recycled to the engine, heat is supplied to the medium by means of a fuel-air burner and water is condensed from the flue gases from the burner to make up any losses in the recycled water.

10. A rotary external combustion engine wherein energy is transferred to a working gas from a heated vaporizable liquid heat-transfer medium, which comprises a stator, a rotor within the stator, a working space defined by the stator and rotor, the volume of the working space being variable by rotation of the rotor from a minimum to a maximum volume;

a heat exchanger for heating the heat transfer medium externally of the working space under a pressure such as to maintain the medium in the liquid state, the heat exchanger having an inlet for receiving heat-transfer medium and an outlet for delivering heated liquid heat-transfer medium;

induction means connected to the stator for inducting gas into the working space;

an injector connected to the outlet of the heat exchanger and arranged to inject the heated pressurized liquid medium into the gas before expansion of the gas in the working space, the injector being mounted in the stator, whereby at least part of the injected liquid vaporizes on injection;

an outlet from the stator which is heat transfer medium and working gas from the working space when the working space is near its maximum volume;

a trap connected to the outlet from the stator for recovering liquid heat-transfer medium from wet exhaust gas containing heat-transfer medium vapor; and a high pressure pump connected for feeding said medium under pressure in the liquid state to the heat exchanger by recycling from the trap.

11. An engine according to claim 1, and including means for injecting heated liquid medium when the working space is near its minimum volume.

12. An engine according to claim 1 wherein the outlet comprises a port in the stator wall which is uncovered by the rotor as the volume of the working space approaches its maximum.

13. An engine according to claim 1 wherein the rotor is provided with a plurality of vanes defining with the interior of the stator a plurality of working spaces.

14. An engine according to claim 1 wherein the interior of the stator is cylindrical, and the rotor is eccentrically mounted therein and provided with a plurality of radially extending vanes defining working spaces, each vane being biased radially outwardly so as to seal against the cylindrical interior surface of the stator.

15. An engine according to claim 1, wherein the injector is provided with two inlets circumferentially spaced apart such that during rotation of the rotor at least one of the inlets remains unobscured by the rotor at all time.

16. An engine according to claim 1, wherein the outlet is disposed approximately 180° C. of rotation away from the injector.

17. An engine according to claim 1, wherein the gas is compressed before the heated liquid medium is injected into the gas.

18. An engine according to claim 17, wherein the gas is compressed by means of a rotary compressor.

19. An engine according to claim 1 wherein the injector is an atomising injector, which atomises the injected liquid medium so as to facilitate heat transfer to the gas.

20. An engine according to claim 1, wherein the heat exchanger comprises at least one tube for containing the heat-transfer medium and a fuel burner for heating the medium in said at least one tube under a pressure such as to maintain the medium in the liquid phase.

21. An engine according to claim 20 wherein the working gas is capable of undergoing or supporting combustion, the outlet from the stator being connected to the burner for feeding exhaust gas to the burner.

22. An engine according to claim 20 wherein the heat exchanger comprises a tube in the form of an inner coil and an outer coil coaxial therewith, the burner being located within the inner coil such that hot flue gas from the burner passes within the inner coil and then between the inner and outer coils.

23. An engine according to claim 1 having a compression ratio between approximately 1.5:1 and 20:1.

24. An engine according to claim 1 wherein the stator and the rotor are formed at least in part from a heat insulating material selected from the group consisting of plastics, fiber-reinforced resins, wood, concrete, glass and ceramics.

25. An engine according to claim 1 wherein the recycle means comprises a spray chamber having an inlet for heat transfer medium and an inlet for flue gases connected to the heat exchanger, the chamber having a spray for spraying liquid heat transfer medium through the flue gas from the burner so as to preheat the liquid medium, the chamber further having an outlet connected for feeding heat-transfer medium to the heat exchanger, and an outlet for flue gas.

26. An engine according to claim 1 wherein the injector is arranged to inject liquid medium continuously.

27. An engine according to claim 1 wherein the stator and rotor are so constructed that some liquid medium is retained in the working space after the exhaust of heat transfer medium.

28. An engine according to claim 27 wherein the stator is provided with a recess for retaining liquid medium.

29. An engine according to claim 27 wherein the rotor is provided with a recess for retaining liquid medium.

30. A rotary external combustion engine wherein heat energy is transferred to air acting as a working gas by means of heated pressurized liquid water at a temperature greater than the boiling point of water at atmospheric pressure, which comprises a stator, a rotor within the stator, a working space defined by the stator and rotor, the volume of the working space being variable by rotation of the rotor from a minimum to a maximum volume;

a heat exchanger for heating the liquid water externally of the working space to a temperature above the boiling point of water at atmospheric pressure, the heat exchanger having (1) an inlet for receiving liquid water and an outlet for delivering heated water, (2) at least one tube for containing said liquid water, and (3) a fuel-burner disposed for heating the liquid water in said at least one tube;

pressurizing means connected to said at least one tube of the heat exchanger for maintaining said heated water in the liquid state;

induction means connected to the stator for inducting air into the working space when the volume of the working space is near its maximum volume;

an injector mounted on the stator and connected to the outlet of the heat exchanger for receiving heated pressurized liquid water, the injector being arranged to inject heated pressurized liquid water into the working space when the working space is near its minimum volume and at least part of said water spontaneously vaporizes;

an outlet from the stator for exhausting cooled water and air from the working space when the working space is near its maximum volume, the majority of said cooled water being exhausted in the liquid state; and a trap connected to the outlet from the stator for recovering liquid water from wet exhaust gas containing water vapor, and connected to the pressurizing means for recycling liquid water to the heat exchanger.

* * * * *

UNITED STATES PATENT AND TRADEMARK OFFICE

CERTIFICATE OF CORRECTION

PATENT NO. : 4,432,203

DATED : February 21, 1984

INVENTOR(S) : Victor H. Fischer

It is certified that error appears in the above-identified patent and that said Letters Patent is hereby corrected as shown below:

Column 12, line 51, after the word "is" insert --controlled to exhaust--.

Column 12, line 62, "1" should be --10--.

Column 12, line 65, "1" should be --10--.

Column 13, line 1, "1" should be --10--.

Column 13, line 4, "1" should be --10--.

Column 13, line 10, "1" should be --10--.

Column 13, line 16, "1" should be --10--.

Column 13, line 19, "1" should be --10--.

Column 13, line 24, "1" should be --10--.

Column 13, line 27, "1" should be --10--.

Column 13, line 43, "1" should be --10--.

UNITED STATES PATENT AND TRADEMARK OFFICE

CERTIFICATE OF CORRECTION

PATENT NO. : 4,432,203

DATED : February 21, 1984

INVENTOR(S) : Victor H. Fischer

It is certified that error appears in the above-identified patent and that said Letters Patent is hereby corrected as shown below:

Column 13, line 45, "1" should be --10--.

Column 13, line 50, "1" should be --10--.

Column 14, line 3, "1" should be --10--.

Column 14, line 5, "1" should be --10--.

Signed and Sealed this

*Nineteenth* Day of *June 1984*

[SEAL]

*Attest:*

GERALD J. MOSSINGHOFF

*Attesting Officer*

*Commissioner of Patents and Trademarks*